US007166141B2

(12) United States Patent
Skinner Macleod et al.

(10) Patent No.: US 7,166,141 B2
(45) Date of Patent: Jan. 23, 2007

(54) VACUUM CLEANER

(76) Inventors: Euan Skinner Macleod, 3/1 12 Naburn Gate, Glasgow, G5 0SQ (GB); Christopher Richard Henderson, 2/R 30 Falkland Street, Hyndland, Glasgow, G12 9QY (GB)

( * ) Notice: Subject to any disclaimer, the term of this patent is extended or adjusted under 35 U.S.C. 154(b) by 40 days.

(21) Appl. No.: 10/817,597

(22) Filed: Apr. 2, 2004

(65) Prior Publication Data

US 2004/0194437 A1 Oct. 7, 2004

(30) Foreign Application Priority Data

Apr. 5, 2003 (GB) ..... 0307929.0

(51) Int. Cl.
*B01D 45/12* (2006.01)
*A47L 9/16* (2006.01)

(52) U.S. Cl. ..... 55/337; 55/508; 55/DIG. 3; 15/353

(58) Field of Classification Search ..... 55/337, 55/428, 504, 505, 508, DIG. 3; 15/352, 15/353
See application file for complete search history.

(56) References Cited

U.S. PATENT DOCUMENTS

| | | | | |
|---|---|---|---|---|
| 3,320,727 | A * | 5/1967 | Farley et al. | 55/337 |
| 4,571,772 | A * | 2/1986 | Dyson | 15/335 |
| 4,944,780 | A * | 7/1990 | Usmani | 55/337 |
| 6,003,196 | A * | 12/1999 | Wright et al. | 15/353 |
| 6,406,505 | B1 * | 6/2002 | Oh et al. | 55/337 |
| 6,521,006 | B2 * | 2/2003 | Park et al. | 55/337 |
| 6,775,882 | B2 * | 8/2004 | Murphy et al. | 15/352 |
| 6,829,804 | B2 * | 12/2004 | Sepke | 15/347 |
| 2002/0108208 | A1 | 8/2002 | Hamada et al. | |
| 2002/0194695 | A1 | 12/2002 | Stephens et al. | |
| 2003/0066156 | A1 * | 4/2003 | Yang | 15/327.2 |
| 2003/0182757 | A1 | 10/2003 | Sepke | |
| 2003/0221277 | A1 | 12/2003 | Oh et al. | |

FOREIGN PATENT DOCUMENTS

| | | |
|---|---|---|
| JP | 2003061878 | 3/2003 |
| WO | WO 02075806 | 10/2002 |

OTHER PUBLICATIONS

European Search Report- Application Number EP 04 25 1834 in The Hague on Feb. 3, 2005.

* cited by examiner

*Primary Examiner*—Frank M. Lawrence
(74) *Attorney, Agent, or Firm*—Cook, Alex, McFarron, Manzo, Cummings & Mehler, Ltd.

(57) ABSTRACT

A vacuum cleaner is disclosed which comprises a body, fan means within the body for creating an airflow through the cleaner and a separation unit mounted to the body for separating dirt and dust from the airflow. The separation unit comprises a cyclone separator and a filter. The filter is removable from the separation unit when the separation unit is mounted to the body of the cleaner.

7 Claims, 3 Drawing Sheets

VACUUM CLEANER

BACKGROUND OF THE INVENTION

1. Field of the Invention

This invention relates to a vacuum cleaner.

2. Related Background Art

Historically, vacuum cleaners have comprised a permeable filter bag for separating entrained dirt and dust from the suction airflow and for collecting the separated dirt and dust. However, many vacuum cleaners nowadays comprise a cyclonic separator, which separates entrained dirt and dust from the suction airflow and deposits it in a receptacle for emptying.

A disadvantage of cyclonic separators compared with filter bags is that cyclonic separators do not always offer the level of filtration efficiency that is achieved with filter bags. In order to overcome this problem, it is commonplace to mount a filter downstream of the cyclone separator. In this manner, virtually all dust and dirt is removed from the suction airflow before the air enters the fan of the vacuum cleaner, with the majority of dirt and dust, including all coarse and fibrous material, being retained in the cyclone separator, and the remaining fine dust being retained on the filter.

Over time, the build up of fine dust on the filter reduces the airflow through the vacuum cleaner and hence the performance of the cleaner is affected unless the filter is periodically replaced or cleaned.

European Patent Application No. 1 195 125 discloses an upright vacuum cleaner having a cyclonic separator and a filter mounted downstream of the cyclonic separator. The filter is located in a chamber directly above the cyclone chamber and is only accessible once the detachable cylindrical dirt-collection bin is removed from the cleaner. In order to remove the filter, the user must reach inside the cleaner to release the perforated cyclone air outlet screen, which is retained by a conventional bayonet fixing, and withdraw the filter from its chamber. The filter may then be washed, dried, and returned to the cleaner.

A disadvantage of the above-mentioned arrangement is that the filter is mounted out of sight and thus there is a tendency for the user to forget to clean the filter regularly. Also, because the filter is mounted out of sight, there is a risk that the cleaner could be used without the filter: it will be appreciated that this will affect the performance and reliability of the cleaner. Another disadvantage of the above-mentioned arrangement is that the filter is awkward to remove and the removal involves handling the filter, which is often coated in dirt and dust.

International Patent Application WO02/28260 discloses an upright vacuum cleaner having a cyclonic separator and a filter mounted downstream of the cyclonic separator. The cyclonic separator and the filter are mounted together in a cylindrical separator unit, which is removable from the vacuum cleaner body for emptying and maintenance. The filter is mounted in the top portion of the separator unit and a transparent cover is provided at the top of the unit, which can be removed once the unit has been disengaged from the cleaner to allow access to the filter inside the unit. The filter then has to be removed from the unit by hand. Following filter cleaning, the filter is replaced in the unit, the cover closed, and the entire separator unit replaced on the vacuum cleaner body.

The complexity of the filter cleaning operation, and the associated exposure of the user to dirt and dust, are likely to be a disincentive to filter maintenance, which may very well compromise sustained efficient operation of the vacuum cleaner.

We have now devised a vacuum cleaner which alleviates the above-mentioned problems.

SUMMARY OF THE INVENTION

In accordance with this invention, there is provided a vacuum cleaner comprising a body, fan means within the body for creating an airflow through the cleaner and a separation unit mounted to the body for separating dirt and dust from the airflow, the separation unit comprising a cyclone separator and a filter, the filter being removable from the separation unit when the latter is mounted to the body of the cleaner.

The filter is an integral part of the separator unit, yet can be removed from the cleaner for maintenance, without the entire separator unit having to be disengaged from the body beforehand. Preferably the separation unit is detachably mounted to the body so that the entire separator unit, with the filter unit in position, may be dismounted as a unit from the cleaner if required, and carried to a disposal point for emptying. Further, because the filter is mounted in the separator unit, it is not enclosed in the body of the vacuum cleaner and is therefore easily accessible for cleaning.

Preferably, the filter is mounted to a removable portion of the separation unit, which portion can be removed when the unit is mounted to the body of the cleaner. In this manner, the filter element can be removed and cleaned by holding the removable portion of the separation unit, thereby avoiding handling of the filter by the user and rendering the task of filter cleaning more hygienic and convenient for the user. Also, an advantage of mounting the filter to a removable portion of the separation unit is that it enables the filter to be held under a running tap for cleaning without the user getting wet or dirty hands.

The cleaning power and efficiency of a vacuum cleaner in accordance with this invention are more likely to be maintained than known cleaners with filters, since the prominent positioning and the ease of accessibility of the filter makes filter cleaning and maintenance less likely to be neglected or overlooked.

Preferably the separation unit is elongate and comprises a removable end wall, the filter being mounted to said removable end wall.

Preferably the separation unit is generally cylindrical.

Preferably the filter is an annular filter which is mounted concentrically within the cylindrical separation unit.

Preferably the removable end wall of the separation unit comprises a projection which engages the filter.

Preferably the separation unit is mounted to the body of the cleaner such that said end wall is exposed and can be removed axially of the separation unit.

Preferably the cleaner is an upright cleaner, the body of the cleaner comprising a floor-engaging portion and an upstanding portion connected to the floor-engaging portion for partial rotation forwardly and rearwardly about a transverse pivotal axis, the upstanding portion comprising a longitudinal axis which extends perpendicular to the pivotal axis, the elongate separation unit being mounted at a forwardly inclined angle to the front of the upstanding portion, such that said end wall faces upwardly in front of the upstanding portion. In this manner, the removable end wall of the separation unit is accessible to the user at the upper extremity of the separator for maintenance of the filter, without the user having to bend down, crouch or adopt another awkward position.

Preferably a handle is provided on the removable portion of the separation unit to which the filter is mounted, in order to enable filter cleaning to be carried out without direct manual handling of the filter by the user.

BRIEF DESCRIPTION OF THE DRAWINGS

An embodiment of this invention will now be described by way of example only and with reference to the accompanying drawings, in which.

DETAILED DESCRIPTION OF THE PREFERRED EMBODIMENT

Figure 1:
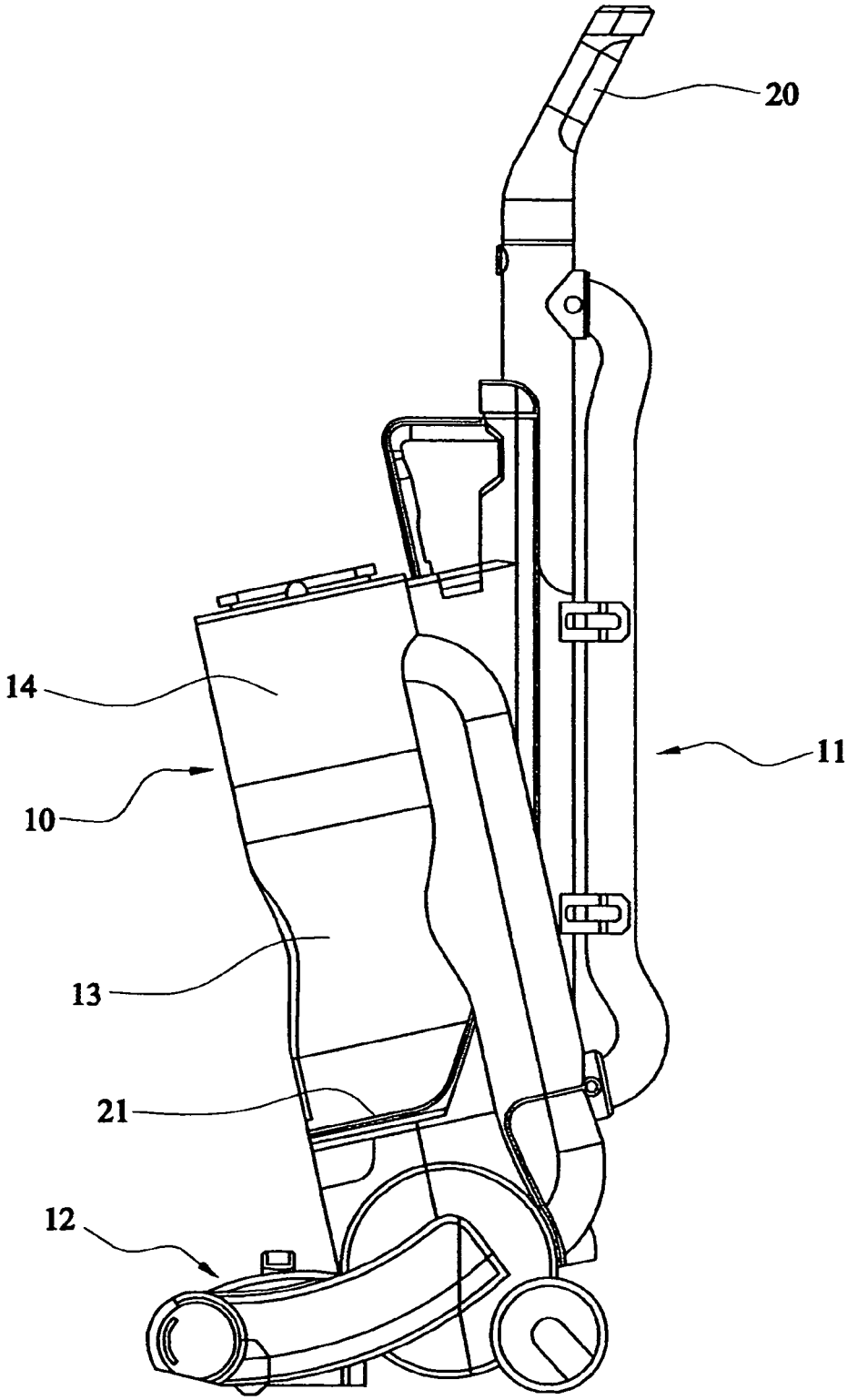
FIG. 1 is a side view of an upright vacuum cleaner in accordance with the invention.

Referring to FIG. 1 of the drawings, there is shown an upright vacuum cleaner comprising a body having an upright upper portion 11 pivotally connected at its lower end to a floor-engaging portion 12 for partial rotation forwardly and rearwardly about a transverse axis. The upper portion 11 of the body encloses a motor/fan unit and comprises a handle 20 at its upper end for pushing the cleaner to and fro. The floor-engaging portion 12 of the body incorporates a suction inlet and a conventional motor-driven rotating brush mounted across the inlet.

A cylindrical separation unit 10 is mounted in an upright configuration to the front of the upper portion 11 of the cleaner, with its longitudinal axis being inclined forwardly and outwardly from its lower end relative to the longitudinal axis of the upper portion 11, such that the upper end wall of the unit 10 is positioned in front of the upper portion 11 of the cleaner.

Figure 2:
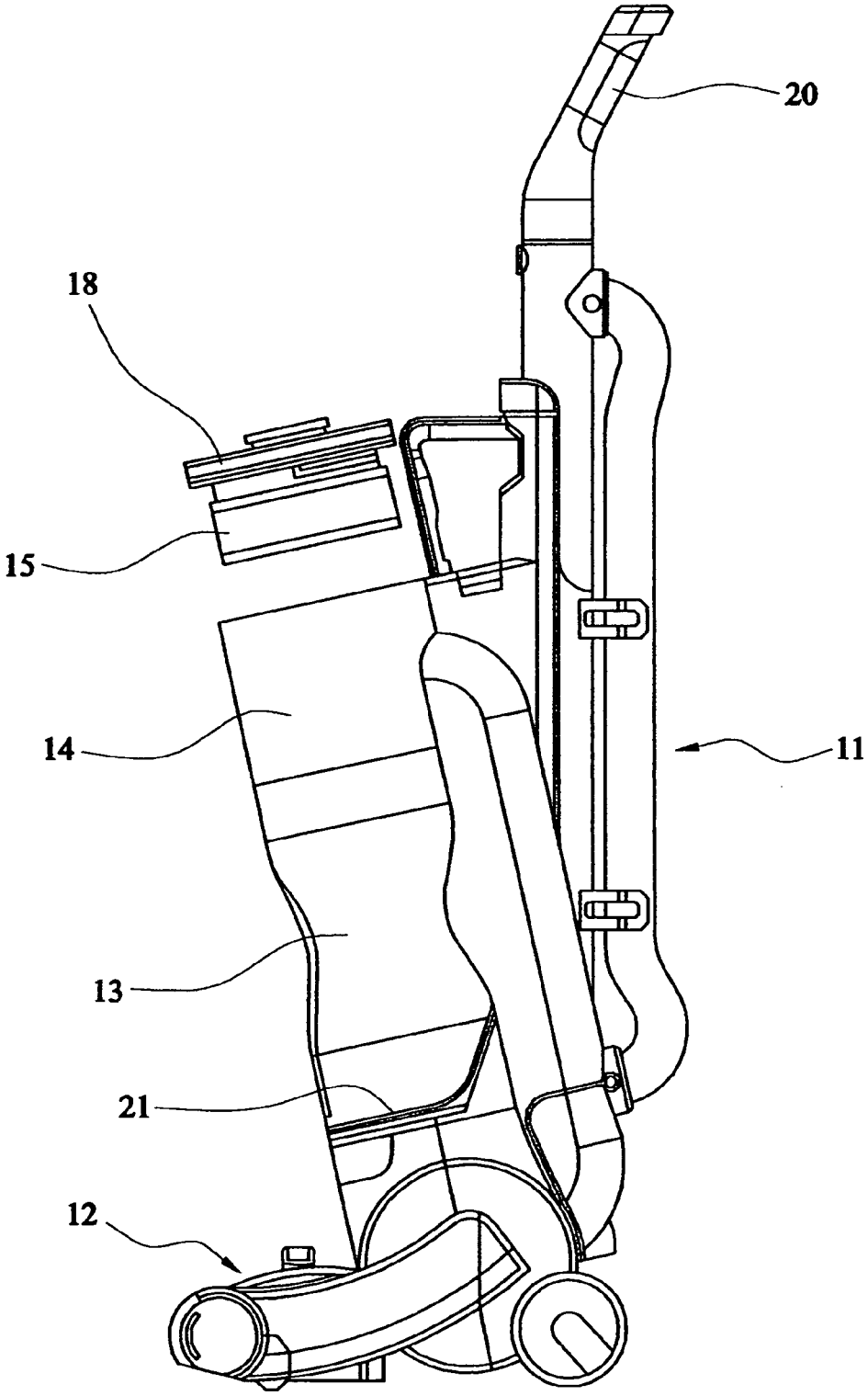
FIG. 2 is a side view of the upright vacuum cleaner of FIG. 1, showing how the filter is removed for cleaning.
Figure 3:
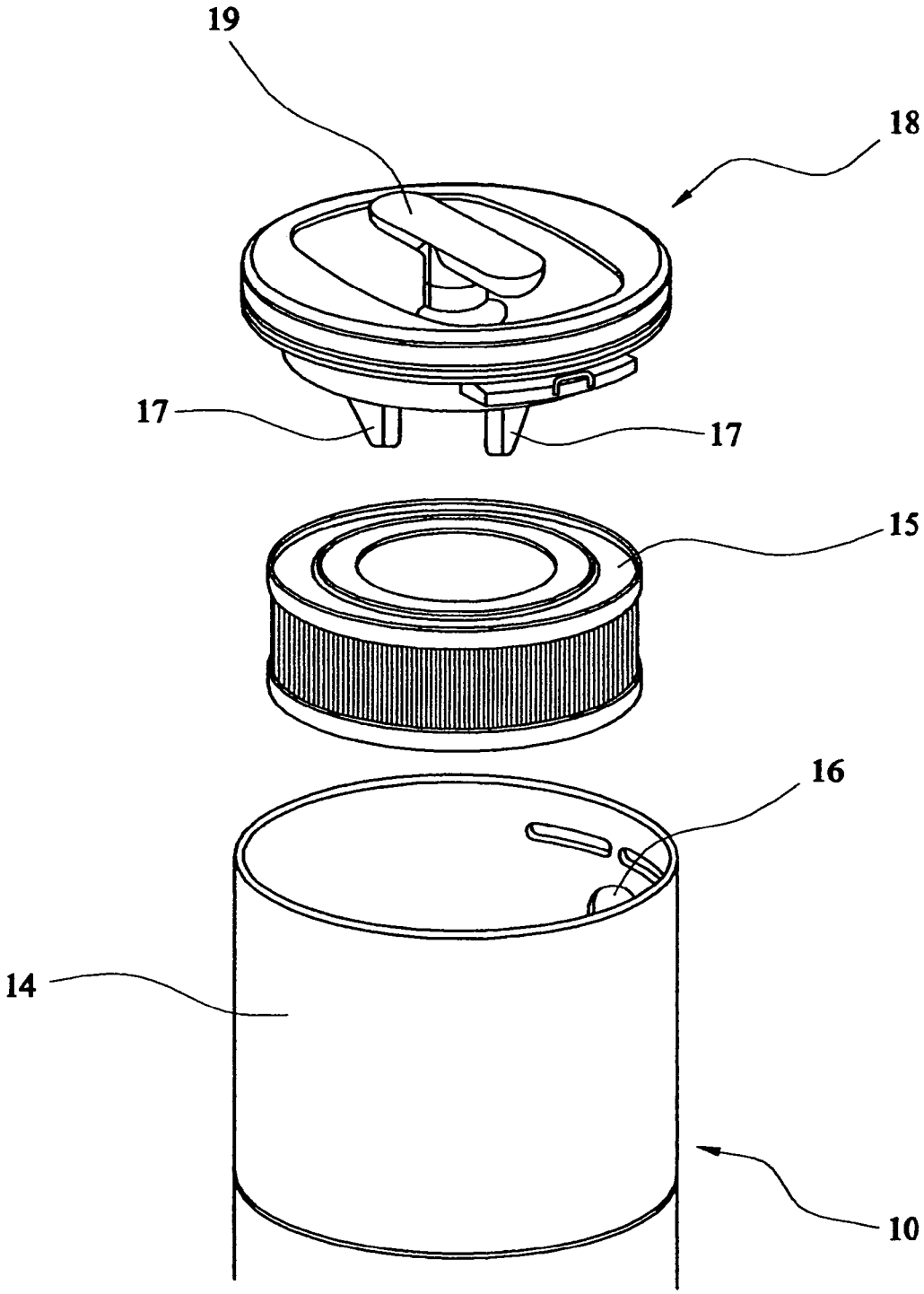
FIG. 3 is a perspective view of the top portion of the separator unit of the vacuum cleaner of FIG. 1, showing how the filter is removed for cleaning.

Referring to FIGS. 2 and 3 of the drawings, the cylindrical separation unit 10 comprises a cyclone separator 13 at its lower end for removing a large proportion of the dirt and dust that is entrained in the airflow. The air leaving the separator flows axially upwardly. A flap 21 closes the bottom end of the unit 10 and an actuator (not shown) is provided on the rear of the unit for opening the flap 21 to allow the separated dirt and dust to be emptied from the unit, once the latter has been detached from the body of the cleaner.

The air leaving the cyclone separator 13 flows axially upwardly into a chamber 14 at the upper end of the unit 10. An annular pleated filter 15 is mounted concentricity inside the chamber 14 and the air leaving the cyclone separator 13 flows upwardly into the center of the filter 15 and then radially outwardly through the filter 15 before leaving the unit 10 through an outlet 16.

The filter 15 is mounted on a plurality of splines 17, which project into the annulus of the filter 15. The closure 18 comprises a handle 19, which can be used to turn the closure to release it from the unit 10. The splines 17 on the underside of the closure 18 securely engage the inside of the filter 15 such that the filter 15 is withdrawn from the unit 10 whenever the closure 18 is removed.

In this manner, the filter 15 can be removed from the unit 10 for inspection, cleaning or replacement, without the user having to directly handle the filter or to get their hands wet whilst washing the filter in water. It will be appreciated that the arrangement of the unit 10 on the body of the cleaner enables the closure 18 to be removed without having to remove the unit 10 from the cleaner. It will also be appreciated that the filter is therefore mounted in a location where it is readily and easily accessible and where the task of filter cleaning or replacement is less likely to be overlooked. As a result, the cleaning power and efficiency of the vacuum cleaner are more likely to be maintained compared with conventional vacuum cleaners, where the filter is difficult to access.

The handle 19 on the closure 18 can also be used to lift the entire separation unit 10 away from the body of the cleaner for emptying, once a separate catch (not shown) has been released.

Whilst an upright vacuum cleaner has been shown and described in the drawings, it will be appreciated that the present invention is equally applicable to a canister or other type of vacuum cleaner.

Reference is made to our co-pending U.S. application Ser. Nos. 10/817,596 and 10/817,546 claiming priority from United Kingdom Patent Application Nos. 0307930.8 and 0307928.2 of 5th Apr. 2003, the disclosures of which are incorporated herein by reference.

While the preferred embodiments of the invention have been shown and described, it will be understood by those skilled in the art that changes or modifications may be made thereto without departing from the true spirit and scope of the invention.

We claim:

1. An upright vacuum cleaner comprising:

a body, said body comprising a floor-engaging portion and an upstanding portion connected to said floor-engaging portion for partial rotation forwardly and rearwardly about a transverse pivotal axis;

fan means within said body for creating an airflow through said cleaner;

an elongate separation unit for separating dirt and dust from said airflow comprising a removable end wall, wherein the elongate separation unit is mounted to the front of said upstanding portion such that said removable end wall faces upwardly in front of said upstanding portion;

said elongate separation unit comprising a cyclone separator and a filter, said filter being mounted to said removable end wall and being removable from said elongate separation unit when said elongate separation unit is mounted to the upstanding portion of said body of said cleaner.

2. An upright vacuum cleaner as claimed in claim 1, in which said elongate separation unit is detachably mounted to the upstanding portion of said body.

3. An upright vacuum cleaner as claimed in claim 1, in which said elongate separation unit is generally cylindrical.

4. An upright vacuum cleaner as claimed in 3, in which said filter is an annular filter mounted concentrically within said elongate cylindrical separation unit.

5. An upright vacuum cleaner as claimed in claim 1, in which said removable end wall of said elongate separation unit comprises a projection which engages said filter.

6. An upright vacuum cleaner as claimed in claim 1, in which said elongate separation unit is mounted to said upstanding portion of said body of said cleaner such that said end wall is exposed and can be removed axially of said elongate separation unit.

7. An upright vacuum cleaner as claimed in claim 1, in which a handle is provided on said removable end wall of said separation unit to which said filter is mounted.

* * * * *